United States Patent [19]

Hignutt et al.

[11] 4,341,504

[45] Jul. 27, 1982

[54] PUMP CONTROL SYSTEM

[76] Inventors: Frank A. Hignutt, 602 "E" St., Millville, N.J. 08332; Robert F. Hignutt, 26 Greenbriar Rd., Turnersville, N.J. 08012; Kenneth W. Hignutt, 36 Porreca Dr., Millville, N.J. 08332

[21] Appl. No.: 101,009

[22] Filed: Dec. 6, 1979

[51] Int. Cl.[3] ..... F04B 41/06; F04B 49/06

[52] U.S. Cl. ..... 417/8; 417/38; 417/45; 417/63

[58] Field of Search ..... 417/2-7, 417/8, 36, 38, 44, 45, 63

[56] References Cited

U.S. PATENT DOCUMENTS

| | | | |
|---|---|---|---|
| 2,314,421 | 3/1943 | Peterson | 417/36 X |
| 3,292,547 | 12/1966 | Ward | 417/7 |
| 3,424,090 | 1/1969 | Hyde | 417/36 |
| 3,520,638 | 7/1970 | McUmber et al. | 417/36 |
| 3,741,683 | 6/1973 | McTamaney et al. | 417/7 |
| 3,751,185 | 8/1973 | Gottliebson et al. | 417/36 X |

*Primary Examiner*—Carlton R. Croyle
*Assistant Examiner*—Edward Look
*Attorney, Agent, or Firm*—Harvey B. Jacobson

[57] ABSTRACT

A bubbler tube is used to sense the liquid level in a wet well. Controls provide a constant flow of air, approximately $1\frac{1}{2}$ to 1 cubic foot per hour, through the bubbler tube which extends to about 6 inches above the top of the pump suction pipe. The pressure in the pipe is proportional to the height of the liquid above the bottom of the bubbler pipe. A transducer connected in the bubbler system responds to pressure changes in the pipe which are transformed to electrical signals used to control the speed of the pump driving motor. The motor will always drive the pump at a speed which corresponds to the flow coming into the wet well.

10 Claims, 4 Drawing Figures

PUMP CONTROL SYSTEM

BACKGROUND OF THE INVENTION

1. Field of the Invention

This invention relates to pump control systems and especially to such systems designed for use in maintaining a constant flow through the wet well of a sewage treatment facility.

2. Discussion of Related Art

Wet wells and settling tanks are commonly used in sewage treatment plants for allowing solids to settle out of the effluent or waste water being treated. It is a well known fact that the most efficient sewage system is one that is gravity fed. When a plant is pulsed by pumps working on and off by float switches, it riles the water and retards the settling of solids, while a constant flow aids settling. Accordingly, it is desirable to maintain proper wet well level by controlling flow from the wet well in response to the gravity fed flow into the wet well.

Various systems have been devised for pump controls. For instance, U.S. Pat. No. 3,937,596, issued Feb. 10, 1976 to Braidwood, shows a fluid pump drive control for a variable speed motor which control utilizes a bubbler tube to provide an accurate indication of the fluid in the wet well. U.S. Pat. No. 3,741,683, issued June 26, 1973 to McTamaney, shows a liquid level control system which uses a plurality of sequentially actuated motors for controlling the rate of flow from a tank. U.S. Pat. No. 3,393,642, issued July 23, 1968 to Kordik, shows an adjustable speed pumping system which uses a bubbler tube for providing an indication of fluid height in a wet well. U.S. Pat. No. 3,463,981, issued Apr. 26, 1969 to Wires, shows a control system for bidirectional electrical motors which are operable as a drive and overdrive for a followup mechanism having utility as part of a motored monometer for indicating and recording fluid level variations. Use is made of a liquid level detector arrangement including a linear differential transformer having a float actuated armature which provides directive signals to a motor controlled circuitry.

While the above cited devices operate effectively, none produces the smooth, controlled operation necessary to insure the most efficient settling of solids from sewage effluent.

SUMMARY OF THE INVENTION

One object of the present invention is to provide a control system for use in wet wells which allows maximum efficient settling in the wet well by controlling the level therein in response to gravity feed thus reducing unwanted rippling.

Another object of the present invention is to provide a pump control system for use in wet wells which system operates efficiently and smoothly so as to enable the use of a relatively small wet well.

In accordance with the above objects, the pump control system of the present invention includes a pair of continuously variable speed pumps connected for discharging fluid from a wet well. A pump selector switch is turned to one of two positions to select which of the pumps is to be the primary pump, with the secondary pump being used only in the event the primary pump cannot handle the load. A bubbler tube is positioned in the wet well approximately 6 inches above the top of the pump suction line. The pumps are then turned on with the primary pump coming up to speed dictated by the bubbler tube setting. Air pressure from the bubbler tube is applied to the top of a mercury reservoir which produces a proportionally smaller movement than the mercury level. The mercury effectively seals the air pressure in the bubbler tube and offers a mechanical damping to rapid fluctuations of air pressure caused by turbulence in the wet well. A magnetic transducer measures the level of mercury in the reservoir with a float in the transducer controlling the level of an iron core which extends through two coils producing a variable voltage output which is applied as the control voltage to the primary pump. A sensitive pressure switch controls the starting and stopping levels of each pump, and a third switch is used to control a high water alarm.

Once the primary pump is running at a speed corresponding to the flow coming into the wet well, should the flow increase the speed will also increase until the pump is pumping its full capacity. At this point, the secondary pump will start and run at full speed with the first pump slowing down until the two pumps in combination are satisfied at the flow demand of of the bubbler system.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Now with relation to the drawings, a pump control system incorporating the principles and concepts of the present invention will described in detail. With specific reference to FIG. 1, it will be seen that the control system comprises a regulated ac supply 10 which provides a constant 110-volt ac output to the control module 14 and a regulated 30-volt ac output to the transducer 26. Regulated supply 10 can be any standard voltage regulated supply which compensates for line fluctuations, surges, spikes, other transients.

Figure 2:
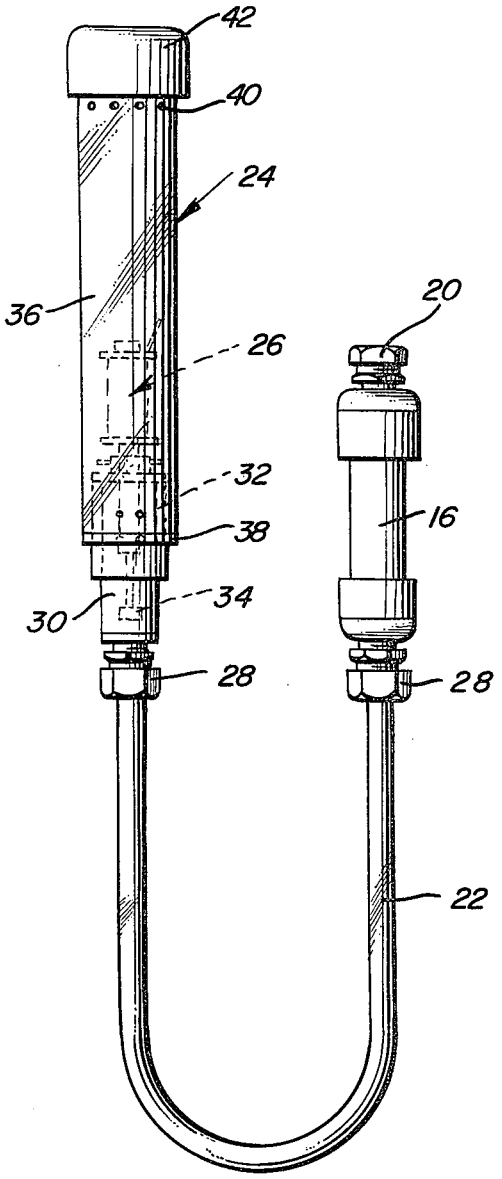
FIG. 2 shows the mercury reservoir and transducer housing of the bubbler tube system.

Transducer 26 is connected to a mercury reservoir 16 which senses the pressure in bubbler tube 18. The reservoir 16 is also shown in FIG. 2 and comprises a hollow tube 22 at least partially filled with mercury. Air pressure from the bubbler tube is applied through coupling 20 at the top of the reservoir and produces movement of the mercury in proportion to the pressure from the bubbler tube. The mercury effectively seals the air pressure in the bubbler tube and offers a mechanical damping to rapid fluctuations of air pressure caused by turbulence in the wet well. By using mercury, sufficient damping is produced to eliminate any need for a feedback circuit. The mercury extends through connector tube 22 into transducer housing 24 which contains a transducer 26. Tube 22 is connected between the mercury reservoir 16 and transducer housing 24 by standard threaded connectors 28 which are normally available for such purposes. The housing 24 comprises a lower cylindrical chamber 30 which is in direct communication with tube 22. Chamber 30 contains mercury and defines the upper and lower limits of the mercury as it moves under the influence of bubbler tube pressure on reservoir 16. The housing also contains an internal upstanding cylindrical wall 32 which mounts transducer 26 such that the bottom of the transducer extends into the lower chamber 30 with float 34 disposed in that chamber for movement in response to a change in level of the mercury. The transducer and cylindrical wall 32 are covered by an outer cylindrical wall 36 which rests on an annular flange 38. Wall 36 contains a plurality of vent openings 40 in the top thereof and is covered by a cap 42. Preferably, a layer of oil is disposed over the top of the mercury in lower chamber 30 and rises up to cover the lower portion of transducer 26 in order to lubricate the transducer when in operation.

Figure 3:
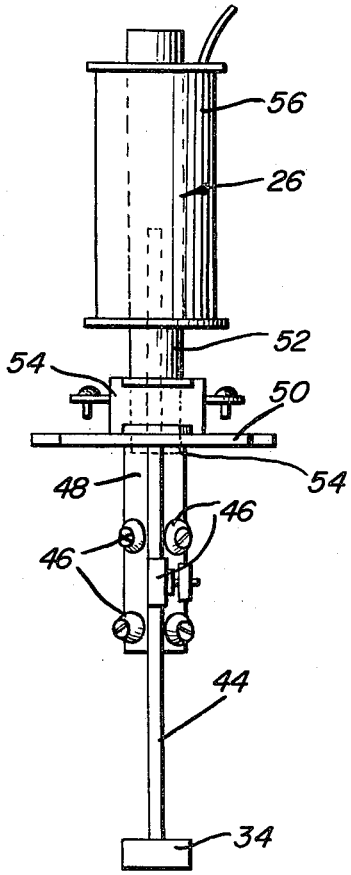
FIG. 3 shows the transducer of the present invention.

The transducer 26 itself is shown in FIG. 3 and includes float 34 which is a plastic float attached to the bottom of a vertically movable iron rod 44. Five guide bearings 46 are mounted on a backing plate 48 and support the rod 44 for vertical displacement. A base plate 50 is mounted on backing plate 48 and mounts the entire transducer 26 in the housing 24 as shown in FIG. 2. A hollow tube 52 is threaded at the bottom and screwed into place in an opening in the base plate 50. An ac coil 54 surrounds the lower portion of tube 52 and is mounted directly on the base plate. A pickup coil 56 is mounted on the upper portion of the tube. The lower coil 54 is constantly fed a 30-volt ac signal. Rod 44 acts as the core of coil 54 and the flux in that core is constant. The rod 44 moves up in the top coil 56 in proportion to the water level in the wet well inducing a varying amount of voltage as the output. There are no electrical connections so there is no arcing or burning and there is nothing to wear out. The whole unit is suspended in oil disposed on top of the mercury in housing 24 in order to lubricate the bearings 46 and to seal the unit from any contamination and corrosion that could result from the surrounding air.

Returning again to FIG. 1, it can be seen that the bubbler tube systems includes an air compressor 58 which feeds an air tank 60. Air tank 60 can preferably be a 10-gallon tank connected to a tank pressure gauge 62. A pressure regulator 64 reduces pressure in the air line from tank 60 to 10 psi, this pressure being registered by line pressure gauge 66. A differential pressure regulator 68 maintains a constant flow of air in the bubbler pipe by automatically changing the air pressure applied to the pipe as the liquid level changes, as would be apparent to one of ordinary skill in the art. The regulator 68 produces a flow of approximately $1\frac{1}{2}$ to 1 cubic feet of air per hour through bubbler tube 18. Of course, the pressure in tube 18 is proportional to the height of liquid level above the bottom of the bubbler tube. One foot of water is equal to 0.433 psi. Accordingly, the pressure changes as seen in bubbler tube 18 are transmitted to reservoir 16 and transducer 26 and registered in a manner discussed hereinabove. A visual monitoring of the system progress can be made through use of water level gauge 20 which indicates the inches of water in the wet well above the bottom of the bubbler tube.

The motor control system comprises a three-phase input shown generally at 72 through circuit breakers 74. Power is supplied through a first fuse 76 and control transformer 78 to the regulated ac supply 10 and also through a second fuse 80 to a dc power unit 82. DC power unit 82 is a high power capacity SCR control module for supplying sufficient power to control any horsepower motor or clutch. This unit converts the ac supply line voltage to dc current. Connected to the power unit 82 is a surge protector 84 which protects against line surges and feedbacks. Protector 84 can be sealed in a plug-in module to prevent damage and to facilitate changing in case of internal damage. Power is supplied from unit 82 to reactor unit 86 which is a saturable three-legged closed laminated core reactor with coils wound on each leg. Also connected to the reactor 86 is a motor starter unit 88 comprising two size 3 magnetic motor starters required with overload cutouts in each of the three phases. Reactor 86 operates motor unit 90 which comprises two motors. Each of the motors is a high slip squirrel cage motor of suitable power to operate any desirable pump. The control module 14 can be actuated either automatically through dc converter 92 which operates in response to the transducer 26 and converts the variable ac output of the transducer 26 to variable dc for use in the control module. Accordingly, the dc level output of converter 92 commands the speed of motor unit 90 and thus the rate at which fluid is pumped from the wet well. A manual switch 94 is provided for selecting either automatic control wherein converter 92 is connected to control module 12 or manual control wherein switch 94 is moved to the opposite position to connect potentiometer 95 to the input of control module 12. Potentiometer 95 is preferably a 10-turn 50 k ohm potentiometer with a 10-turn dial for providing accurate control over a broad speed range.

Figure 1:
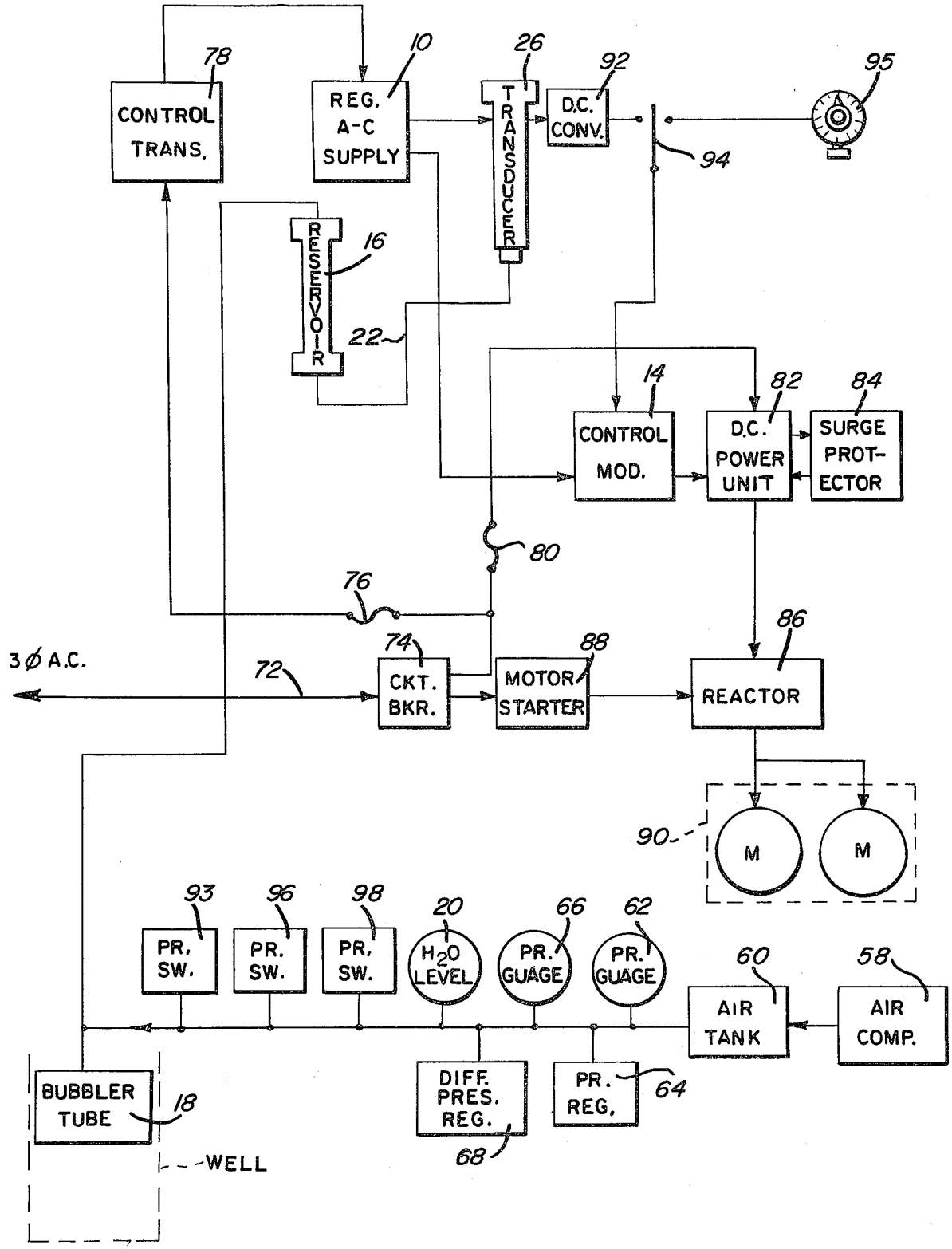
FIG. 1 is a block diagram of the control system of the present invention.

Finally, a plurality of pressure responsive switches 93, 96, 98 are connected to the bubbler tube system to actuate the control module 14 and thus control the motor unit 90. These pressure switches are shown in FIG. 1 and labelled 93, 96 and 98. Switch 93 is set to be actuated at the lowest pressure and causes operation of the lead motor of the motor unit 90. Switch 96 is set to operate at a higher pressure and causes the second motor of motor unit 90 to be turned on. Switch 98 can be set at the highest pressure and causes a high water alarm located remote from the control panel to actuate giving an indication of the inability of the pumps to maintain a proper water level in the wet well.

Figure 4:
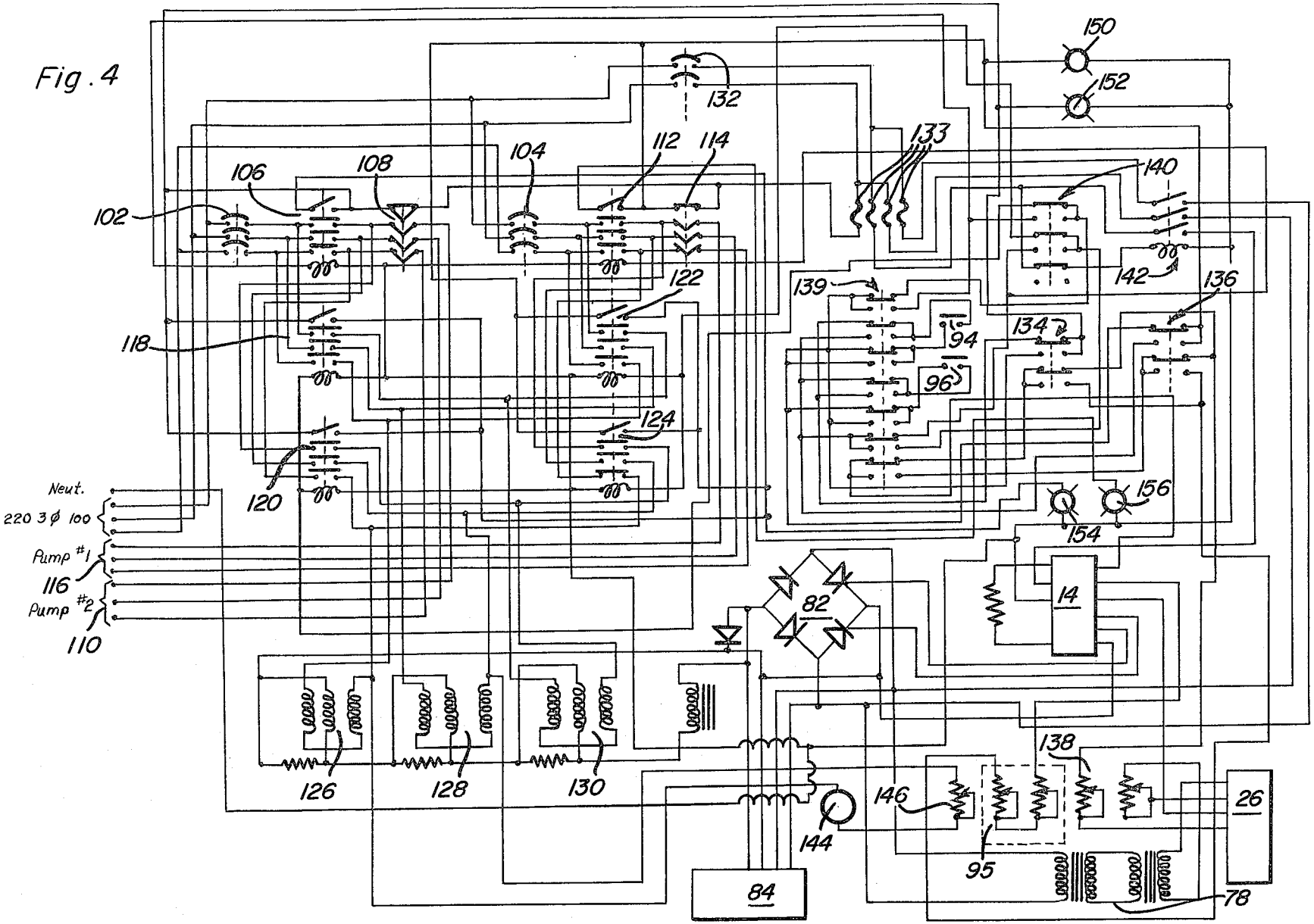
FIG. 4 is a detailed schematic diagram of the control system of the invention.

With reference to FIG. 4, a detailed schematic of the pump control system can be seen. The main three-phase ac power for the system comes in through input lines 100 and is supplied to circuit breakers 102 and 104 which are each 220-volt 30-amp. breakers. The power supplied through breaker 102 is presented to a start relay 106 which, when actuated causes application of the three-phase power through switch 108 directly to the output 110 causing full speed operation of pump No. 2. In like manner, the three-phase power applied through circuit breaker 104 is presented to start relay 112 which, when energized, presents full power through switch 114 to output 116 for pump No. 1. Variable speed operation of the pumps is effected through the use of contactors 118 and 120 for pump No. 2 and the contactors 122 and 124 for pump No. 1. Contactors 118, 122 are effective when activated to pass three-phase power to three-saturable core reactors 126, 128 and 130 which comprise reactor unit 86. Each of these reactors has a three-legged, closed laminated core, with coils wound on each leg. The middle coil is the control winding and is fed from dc variable power unit 82. The two outside coils are used for the ac load connections.

The outputs of each of the reactors are connected to contactors 120, 124 for use in controlling either pump 2 or pump 1 respectively. The output power is passed from the contactors 120, 124 through switches 108, 114 for such operation.

Two of the three phases of input power pass through a smaller circuit breaker 132 for supplying power to the control functions of the systems. These two lines are fused at 133 with single phase power being taken from the fuses.

Manual or automatic operation of the system is dictated by use of switches 134 and 136. Switch 134 is associated with pump No. 1 and commands manual or automatic operation of that pump while switch 136 is similarly associated with pump No. 2. In the position shown, each switch is engaged for automatic operation and causes the output of transducer 26, taken through an adjustment pot, to be connected to control module 14. In the opposite position, each switch would be effective to connect potentiometer 95 through switch 94 directly to control module 14 to control the speed of pumps 1 or 2. In either case, switches 134, 136 are connected through lead pump selector 139, the position of which determines which of the pumps will serve the primary pumping function. The switch 134, 136 associated with the selected pump serves as the manual-automatic switch for the entire system while its associated pump is the primary pump. The pump which is chosen to be primary through selection of potentiometer 138 is connected to pressure sensitive switch 93 while the other pump is controlled through pressure switch 96.

In operation, the pump which is chosen to be primary is driven with a speed proportional to the pressure sensed in the bubbler tube when pressure sensitive switch 94 is actuated. This control is effected through control module 14 and saturable core reactors 126, 128, 130. If the water level in the wet well rises sufficiently to actuate switch 93, the secondary pump becomes actuated directly through its associated starter relay 106 or 112. Accordingly, the secondary pump is automatically run at full speed while the first pump is speed controlled. If it is desired to have both pumps run at maximum speed when actuated, selector switch 140 can be moved from the position shown in which case relay 142 will be deactuated and, when commanded, each pump will operate solely through its starter relay 106, 112 and thus operate only at high speed.

It can also be seen that a speed indicator 144 is provided to show the speed of the pump motor which is being speed controlled. Indicator 144 is associated with an adjustment potentiometer 146. Other features of the invention include bulbs 150 and 152 which are illuminated upon the application of power to the controls for pumps 1 and 2 through closure of switches 114 and 108, respectively. Also, a second pair of bulbs 154, 156 are provided and illuminated respectively when pumps 1 or 2 are actually operating.

The preferred mode of operation is as follows:

With the switches 108, 114 both in the "on" position, the lead pump selector switch 139 is returned to the number one position, making the number one pump the lead or control pump. Both manual-automatic switches 134, 136 should be turned to the automatic position as shown whereupon the number one pump will start and come up to the speed dictated by the bubbler tube setting. The bottom of the bubbler tube should be placed about 6 inches above the top of the pump suction line. The inches of water above the top of the bubbler tube is shown on water level gauge 20 which is on the front of a control panel. This gauge can be used in setting up the various control switches and the transducer 26. Pressure switches 93, 96 control the starting and stopping levels of the pumps 1 and 2, respectively, and the third pressure switch 98 is used to control a high water alarm located remote from the control panel. The low level of the transducer 26 is set to slow pump 1 down to a speed just before it reaches its cutoff point, at which time the pressure switch 93 opens to shut the pump off.

Should the flow increase, the speed of pump 1 will also increase until the pump is pumping its full capacity. At this point, the number two pump will start and run at full speed and the number one pump will slow down until the two pumps in combination are satisfying the flow that the bubbler system is calling for. When the flow drops to a point where the number one pump will handle the flow, the number two pump will drop off and the number one pump will speed up to accommodate the flow.

The pumping system is set up in such a way as to be fail-safe. If anything should happen to either the lead pump or the motor or controls, the opposite pump will operate on its own pressure switch independent of the lead pump controls.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pump system for maintaining a flow of fluid through a well comprising:

a pair of terminals for connection to a power supply;

pump means connected to said terminals of said power supply for pumping fluid from said wet well;

motor means connected to said pump means for driving said pump means, said motor means comprising a variable speed electric motor;

liquid level sensing means disposed in said wet well for providing an output proportional to the level of fluid in said wet well; and control circuit means for receiving said output of said liquid level sensing means and controlling the speed of said motor in response thereto, said control circuit means including reactor means connected to said terminals of said power supply and said motor means, said motor means further including a second motor and said pump means including two pumps one of which is connected to said first mentioned motor, the other of which is connected to said second motor, said control circuit means further includes means for operating said second motor at constant full speed in response to the output from said liquid level sensing means reaching a predetermined level, whereby the first mentioned motor only is operative at a variable speed until the pump connected thereto reaches the maximum capacity at which point the second motor is operated at a constant full speed with the first mentioned motor then being operated at variable speed in response to the output of the liquid level sensing means.

2. A pump system for maintaining a flow of fluid through a wet well, said system comprising:

a power supply:

pump means connected to said power supply for pumping fluid from said wet well;

motor means connected to said pump means for driving said pump means, said motor means comprising a variable speed electric motor;

liquid level sensing means disposed in said wet well for providing an output proportional to the level of fluid in said wet well; and control circuit means for receiving said output of said liquid level sensing means, and controlling the speed of said motor in response thereto;

said liquid level sensing means comprising a bubbler tube means extending into said wet well for producing an output pressure related to the depth of fluid in said wet well;

transducer means comprising a differential transformer having a core which moves in response to changes in pressure in said bubbler tube means.

3. The system as defined in claim 2 and further including a mercury reservoir connected between said bubbler tube means and said differential transformer, said core having a float disposed in said mercury reservoir.

4. The system as defined in claim 3 wherein said differential transformer includes a base plate having a hollow tubular member disposed thereon, a transmitter coil disposed about said hollow tubular member, a receiver coil disposed about said hollow tubular member and spaced vertically from said transmitter coil, said core comprising a metallic rod extending downwardly through said hollow tubular member and mounted for vertical displacement within said hollow tubular member.

5. The system as defined in claim 2 and further including manual speed control means selectively engageable with said motor means for manually controlling the speed of said motor means.

6. The system as defined in claim 2 wherein said differential transformer includes a base plate having a hollow tubular member disposed thereon, a transmitter coil disposed about said hollow tubular member, a receiver coil disposed about said hollow tubular member and spaced vertically from said transmitter coil, said core including a metallic rod extending downwardly through said hollow tubular member and mounted for vertical displacement within said hollow tubular member.

7. A pump system for maintaining a flow of fluid through a wet well, said system comprising:

a power supply;

pump means connected to said power supply for pumping fluid from said wet well;

motor means connected to said pump means for driving said pump means, said motor means comprising a variable speed electric motor;

liquid level sensing means disposed in said wet well for providing an output proportional to the level of fluid in said wet well; and control circuit means for receiving said output of said liquid level sensing means and controlling the speed of said motor in response thereto, said variable speed motor being a three-phase motor and said control means including three saturable core reactors connected to said power supply and said motor.

8. The system as defined in claim 7 and further wherein said control circuit means includes a rectifier bridge containing at least one SCR for providing dc potential to said saturable core reactors.

9. A pumping system for use in wet wells, comprising;

a first pump connected to a variable speed electric motor;

a second pump connected to a constant speed electric motor;

a sensor means disposed in said wet well for measuring the level of fluid therein;

control means connected to said sensor means for operating the variable speed electric motor at a speed proportional to the output of said sensor means;

control means for operating the constant speed motor at a full constant speed only when the output of said sensor means indicates the level of fluid in said wet well has reached a predetermined height, said sensor means including a bubbler tube;

fluid chamber means connected to said bubbler tube, said fluid chamber means containing a fluid which moves in response to changes in pressure from said bubbler tube; and transducer means including a float disposed in said fluid, said float being displaced in response to changes in pressure from said bubbler tube, said transducer means including a differential transformer having a movable core, said float being connected to the core of said differential transformer.

10. The system as defined in claim 9 and further including switch means for causing operation of both of said motors.

* * * * *